US007004327B2

(12) United States Patent
Jerzembski et al.

(10) Patent No.: US 7,004,327 B2
(45) Date of Patent: Feb. 28, 2006

(54) METHOD FOR SINK AND FLOAT SEPARATION OF FINE GRAINED MINERAL RAW MATERIALS

(75) Inventors: Heinrich Emil Jerzembski, Heerlen (NL); Jan Bot, Avenhorn (NL)

(73) Assignee: Enerco B.V., Buchten (NL)

( * ) Notice: Subject to any disclaimer, the term of this patent is extended or adjusted under 35 U.S.C. 154(b) by 120 days.

(21) Appl. No.: 10/473,514

(22) PCT Filed: Mar. 1, 2002

(86) PCT No.: PCT/IB02/02016

§ 371 (c)(1),
(2), (4) Date: Apr. 5, 2004

(87) PCT Pub. No.: WO02/078850

PCT Pub. Date: Oct. 10, 2002

(65) Prior Publication Data

US 2004/0164002 A1 Aug. 26, 2004

(30) Foreign Application Priority Data

Mar. 30, 2001 (DE) ..... 101 16 027

(51) Int. Cl.
*B03B 5/28* (2006.01)

(52) U.S. Cl. ..... 209/172.5; 209/173; 209/451; 209/498; 209/697

(58) Field of Classification Search ..... 209/172, 209/172.5, 173, 687, 689, 451, 493, 497
See application file for complete search history.

(56) References Cited

U.S. PATENT DOCUMENTS

| | | | | | |
|---|---|---|---|---|---|
| 1,392,401 | A | * | 10/1921 | Chance et al. | 209/172.5 |
| 1,559,938 | A | * | 11/1925 | Chance | 209/172.5 |
| 2,590,756 | A | * | 3/1952 | Colin et al. | 209/173 |
| 2,760,633 | A | * | 8/1956 | Davis | 209/172.5 |
| 4,267,980 | A | * | 5/1981 | LaPoint | 241/20 |
| 5,082,553 | A | * | 1/1992 | Tanii | 209/3 |
| 5,495,949 | A | * | 3/1996 | Olivier | 209/172.5 |

FOREIGN PATENT DOCUMENTS

DE 968121 5/1951

(Continued)

*Primary Examiner*—Donald P. Walsh
*Assistant Examiner*—Joseph Rodriguez
(74) *Attorney, Agent, or Firm*—Davidson, Davidson & Kappel, LLC

(57) ABSTRACT

A separating apparatus for the sink and float separation of a mineral raw material according to density using a liquid. The separating apparatus includes a rotatable drum including a plurality of sink-product pockets for discharging a sink product of the mineral raw material. The apparatus also includes a raw material inlet for delivering the raw material into the liquid bath, a first liquid inlet and first liquid outlet including an overflow disposed at a top level of the liquid bath, and a second liquid inlet and second liquid outlet. The separating apparatus also includes a front deflecting barrier and a rear deflecting barrier, each projecting into the liquid bath from above and disposed over an entire width of the liquid bath. In addition, a method for the sink and float separation according to density of a mineral raw material using a liquid.

22 Claims, 2 Drawing Sheets

FOREIGN PATENT DOCUMENTS

| | | |
|---|---|---|
| DE | 1031234 | 6/1958 |
| DE | 1053433 | 3/1959 |
| DE | 1193892 | 6/1965 |
| DE | 3327040 | 2/1985 |
| GB | 804616 | 11/1958 |
| GB | 1050259 | 12/1966 |

* cited by examiner

METHOD FOR SINK AND FLOAT SEPARATION OF FINE GRAINED MINERAL RAW MATERIALS

The present invention relates to an apparatus for the sink-and-float separation of mineral raw materials and to a method for the sink-and-float separation of mineral raw materials.

For the processing of mineral raw materials and their separation from undesirable accompanying constituents, for example for the separation of the debris constituents contained in raw coal and the clean coal, various separating methods are known which separate the various constituents of the raw material on the basis of their different specific weights, for example dynamic methods such as cylinders or cyclones, in which dense medium rotates and forms a vortex, or jigs, but also static methods with washing drums (sink-and-float separating apparatuses). For the processing of fine-grained mineral mixtures, in particular raw coal fractions as well, for example smaller than 12 mm, virtually only dynamic separating methods with cylinder or cyclone were suitable hitherto if a high separation grade was required, but said dynamic separating methods have the disadvantage of a low delivery and throughput capacity with high specific consumption of energy and pulp throughput. Although it was possible to achieve higher capacities with jigs and sink-and-float separation apparatuses, the separation grade to be achieved with these apparatuses and corresponding methods was inadequate.

This situation is explained by the table below, in which technical classification figures of some separating methods for coal are compared. In this case, the DWP cylinder represents cylinders and the DSM cyclone represents cyclones, and the washing drum represents a sink-and-float separating apparatus, the values specified applying to the processing of a grain fraction of 3 to 12 mm with cylinder and cyclone and of coarse coal with the washing drum. The values for the processing of the grain fraction of 3 to 12 mm with the washing drum would be considerably poorer. The characteristic figure according to Terra $E_T$, which was determined from the partition curve according to Tromp, was selected as a measure of the separation grade. In this case, the $E_T$ values of 0.04 for cylinder and cyclone are nearer to theoretical target values which can scarcely be reached in practice.

| Method | | DWP cylinder | DSM cyclone | Washing drum |
|---|---|---|---|---|
| Grain size | | –3 to 12 mm- | | Coarse coal |
| Size | | Ø 400 mm | Ø 600 mm | Bath 1780 mm |
| Material delivery | $m^3/h$ | 35 | 80 | 140 |
| | $E_T$ | 0.04–0.07 | 0.04–0.07 | 0.09 |
| Pulp quantity | $m^3/h$ | 170 | 450 | 220 |
| | $m^3/t/h$ | 6.3 | 7.5 | 2.2 |
| Pumping capacity | kW | 37.5 | 75 | 37.5 |

Apparatuses and methods described at the beginning have been disclosed by DE 11 93 892 and DE 33 27 040.

Apparatuses and methods described at the beginning have also been disclosed by DE 968 121, the apparatus additionally having a second inlet and outlet pair for the liquid below the liquid level. In the method described therein, the bottom liquid flow is so strong that it drives heavy material into the region of the scoop feeders, arranged laterally on the end face of the drum, for the sink-product/heavy-material discharge and acts as a transport flow for heavy material. In this case, float product adhering to the heavy material may be discharged with the sink product, as a result of which the yield drops.

SUMMARY OF THE INVENTION

The present invention is based on the technical problem of developing an apparatus with which mineral raw materials, in particular coal of small-grained fractions, can be separated according to density from undesirable accompanying constituents and with which a high separation grade and capacity can be achieved with a low specific consumption of energy and throughput of operating media, and to propose a method with which this object can be achieved.

With the apparatus proposed, it is possible to build up a dense-medium bath with a steady, uniform flow from the inlet side of the separating vessel to the outlet or overflow side. In order to avoid disturbing effects on the uniform flow, the discharge drum is only rotated slowly. In particular, care is also to be taken to ensure that the same pulp quantities are fed and discharged at the bottom inlet and outlet so that the flow runs horizontally and no vertical flows are superimposed.

With the apparatus proposed, with values which were otherwise the same as with the conventional washing drum for coarse coal, it was possible to process a grain fraction of 3 to 12 mm with an $E_T$ of 0.02 and thus a very good separation grade. It was even possible, although with half the feed quantity of 70 $m^3/h$, to separate a coal grain fraction of 1 to 3 mm having a very clean end product, which indicates a high degree of separation.

The deflecting barriers proposed in a special embodiment cause the float product floating at the surface to plunge into the dense-medium bath, as a result of which the grains perform a movement relative to the dense medium and in the process are separated from sink-grain fractions possibly still adhering or from enclosed sink-grain fractions, so that one can subsequently float up again in separated form. The rear deflecting barrier in the direction of flow has the advantage that it divides the float-product layer and reduces the thickness of the float-product layer, as a result of which the heavy material is liberated from the surrounding float product and can sink unhindered. The course of the bottom edge of the deflecting barrier parallel to and just below the liquid level has the advantage that the dense-medium flow is deflected in a way that does not disturb the uniform and essentially laminar flow.

In a preferred embodiment, the plate of the rear deflecting barrier in the direction of flow has corrugations arranged parallel to one another, so that on the bottom of the corrugation profile only relatively small float-product layers form, which with their small surface size, influence and decelerate the flow to only a minimum extent. The corrugations may have both a rounded-off profile and a V-shaped profile. The height of the arrangement of the rear deflecting barrier is advantageously empirically set in such a way that a desired fraction of the float product is caught by the deflecting barrier and forced downward into the bath. An expedient control variable for the fraction to be caught is the separation grade of the separated material, which is expediently to be determined at the overflow.

In a special embodiment, the top inflow line for the dense medium extends over the entire bath width. An essential precondition for the formation of a uniform flow over the entire bath width is thus provided. This can be arranged in an especially advantageous manner if the inlet device permits the control of the flow profile over its width. This is possible, for example, by an inlet device which consists of a vessel extending over the bath width and having at least one inlet opening and, toward the separating vessel, a multiplicity of equispaced openings, the cross section of which can be specifically reduced from inside. This may be effected, for example, by screens which are arranged inside the vessel and can be operated from outside and with which the free cross sections of the individual outlet openings can be specifically covered, as a result of which the discharging liquid flow is reduced. With such an apparatus, discontinuities or disturbances of the flow which are observed during operation can be specifically countered.

In a further special embodiment, the apparatus, for the delivery of the raw material to be separated, has a chute which is inclined towards the separating vessel and which has a plate which is arranged on the base and consists of a profiled material corrugated in the longitudinal direction, the end of this chute being arranged at an adjustable distance above the liquid bath. The inclination of the chute and the arrangement of its end above the liquid bath causes the raw material to be delivered onto the liquid bath, at a speed adjustable by the inclination, and to plunge into said liquid bath. The corrugated design of the chute base leads to a reduction in the frictional resistance and thus in the braking effect of the base layer. The spraying of the feed material with water assists the discharge of the raw material from the chute and dilutes the dense medium in the region of the raw-material delivery, thereby favouring the heavy-material constituents to sink. It is also important that the first deflecting barrier is arranged in such a way that it lies downstream of the trajectory parabola of the feed material, so that the latter does not hit the deflecting barrier, a factor which would lead to a reduction in the feed rate and thus to a reduction in the depth to which the raw material plunges into the dense-medium bath.

The uniform distribution of a large number of sink-product pockets over the circumference of the drum shell causes the sink product to be correspondingly distributed over the various sink-product pockets and ensures that the pockets are not filled unevenly or to an excessive degree. The liquid-permeable design of the walls of the sink-product pockets, together with the small extent the pockets are filled with the sink product, ensures that no liquid is skimmed off when a sink-product pocket is lifted out of the liquid bath and that the liquid level is not greatly affected by the only slight displacement volume of the pocket contents.

The formation of two horizontal liquid flows has the advantage that the float product is conveyed to the overflow with the top liquid flow, and the sink product is caught by the flow at two different bath heights and is moved relative to the dense medium, whereby the separated heavy material can sink and adhering float product can be released and can float up. The extent to which the heavy material is caught by the flow is increased by the flow deflection. The delivery of the raw material at high speed to the liquid bath and the deep plunging of the sink-p product fractions caused thereby favours the separation of the heavy-material fractions from adhering float-product grains, which is also intensified by the spraying of the raw material with water and by the resulting dilution of the dense medium in the region of the raw-material delivery.

BRIEF DESCRIPTION OF THE DRAWINGS

The advantages of the invention are explained in the description of an exemplary embodiment, which is shown in the attached drawing, in which.

DETAILED DESCRIPTION

Figure 1:
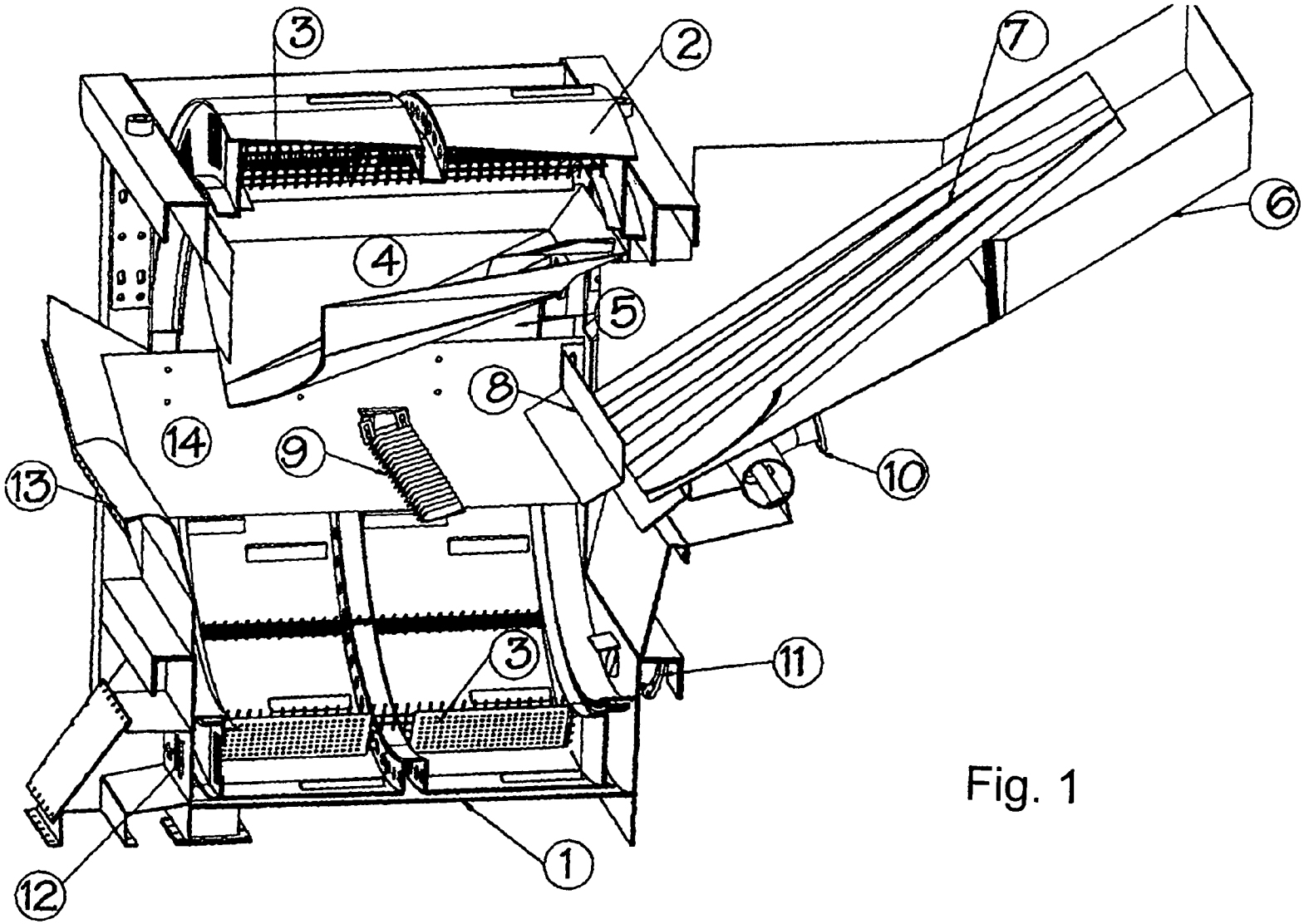
FIG. 1 shows a partly sectioned sink-and-float separating apparatus in perspective representation.

A partly sectioned sink-and-float separating apparatus is shown in perspective representation in FIG. 1. In the trough-shaped separating vessel 1, the drum 2 is rotatably arranged. The drum is driven by four vertically adjustable gears (not shown) by means of a centrally arranged pinion (likewise not shown) engaging in the toothed rim. The sink-product pockets 3 distributed over the inner circumference of the drum shell can be clearly seen, their walls being designed to be permeable to liquid. When the sink-product pockets are rotated into a top position, the sink product discharged into the sink-product pockets falls downward by gravitational force into a sink-product chute 4, by means of which the sink product is brought out of the separating vessel. In order to prevent the sink product from falling back onto the pulp bath or onto the float product floating thereon, cover plates 5 are arranged in the top area. The raw material to be separated is delivered via the delivery chute 6, which has a corrugated base 7. The front deflecting barrier 8, which in the exemplary embodiment shown has the form of an angled plate, and the rear deflecting barrier 9, which consists of a corrugated plate arranged transversely to the direction of flow and, like the front deflecting barrier, extends over the entire bath width, can readily be seen. The top pulp inlet 10 and the overflow weir 13 arranged opposite at the same height can clearly be seen. The bottom pulp inlet 11 and, opposite it, the outlet opening 12 of the bottom pulp outlet can clearly be seen just above the sink-product pockets 3. The pulp-bath boundary plate 14, to which the one end of the rear deflecting barrier 9 is fastened, is shown in the top rear region.

Figure 2:
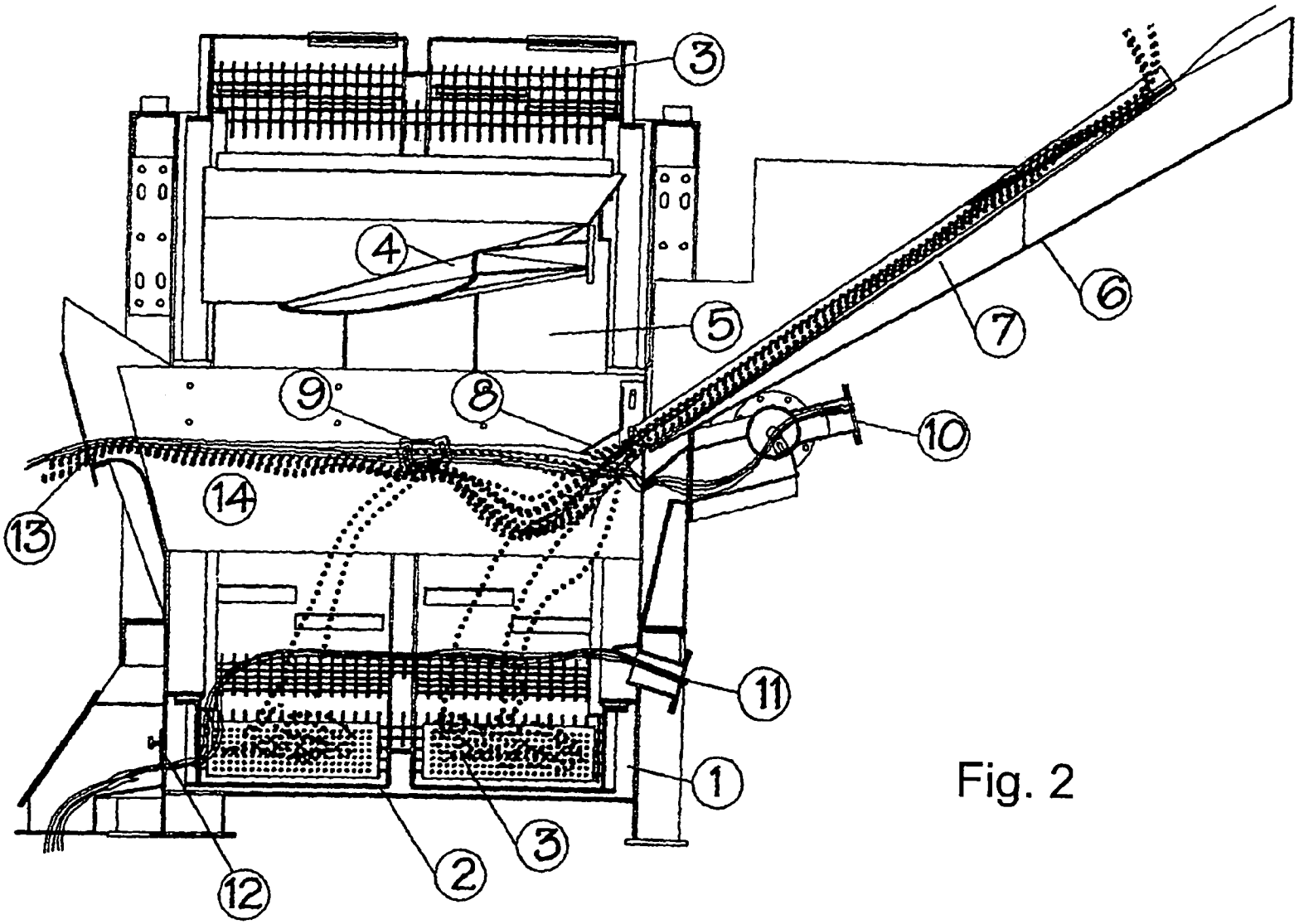
FIG. 2 shows the front view of a sectioned apparatus according to FIG. 1 during operation.

The front view of a sectioned apparatus during operation is shown in FIG. 2. Via the delivery chute 6 having the corrugated base 7, the raw material is delivered from the right at high speed by the inclination of the chute 6, if possible without retardation, onto the dense-medium bath in such a way that it plunges into the bath. Approximately at the height of the pulp bath, fresh pulp is fed on the right-hand side via the top pulp inlet 10, whereas arranged opposite it at the same height is the overflow weir 13, via which the horizontal flow of float product is discharged, with corresponding pulp quantities also flowing off. While the sink-product fraction sinks down through the pulp bath, the float product is conveyed to the overflow weir by the horizontal dense-medium flow. The pulp flow is deflected by the front deflecting barrier plunging into the pulp bath and by the rear deflecting barrier 9 arranged approximately in the center between inlet 10 and overflow weir 13. The float-product fractions floating at the top are forced downward into the bath by the deflection of the pulp flow, as a result of which the separation of sink-product fractions from adhering float-product fractions is intensified and the separating effect is favorably influenced overall. The sinking heavy material falls into the sink-product pockets 3 distributed over the circumference and is conveyed upward by the rotation of the drum and discharged. After appropriate rotation of the drum, the sink product falls onto the sink-product chute 4, via which the sink product is discharged from the separating apparatus.

The bottom pulp inlet 11 and the outlet opening, arranged opposite it at the same height, of the bottom pulp outlet 12 can readily be seen in this representation. The sinking heavy material is caught by the horizontal pulp flow formed between the pulp inlet and the pulp outlet and is moved once again relative to the dense medium, which promotes further separation of the sink-product fractions from adhering float-product fractions. After this second separating stage, the float product rises again in order to be combined with the top pulp flow and discharged toward the overflow weir 13. The cover plates 5 arranged in the top rear region and the pulp-bath boundary plates 14 can also be clearly seen.

LIST OF DESIGNATIONS

1 Separating vessel (trough)
2 Drum
3 Sink-product pockets
4 Sink-product chute
5 Cover plates
6 Delivery chute
7 Corrugated base
8 Front deflecting barrier
9 Rear deflecting barrier
10 Top pulp inlet
11 Bottom pulp inlet
12 Outlet opening of bottom pulp outlet
13 Overflow weir
14 Pulp-bath boundary plates

What is claimed is:

1. A separating apparatus for the sink-and-float separation according to density of a mineral raw material using a liquid, the separating apparatus comprising;

a drum rotatable about a drum axis for holding a quantity of the liquid as a liquid bath, the drum including a plurality of sink-product pockets disposed on an inner circumference of the drum for discharging a sink product of the mineral raw material;

a raw material inlet for delivering the raw material into the liquid bath;

a first liquid inlet disposed at a top level of the liquid bath;

a first liquid outlet opposite the first liquid inlet and at the top level of the liquid bath, the first liquid outlet including an overflow for separating a float product of the raw material;

a second liquid inlet;

a second liquid outlet disposed opposite the second liquid inlet and at a same height as the second liquid inlet, each of the raw material inlet, first and second liquid inlets and first and second liquid outlets being arranged parallel to the drum axis, a front deflecting barrier; and a rear deflecting barrier, wherein each of the front and rear deflecting barriers project into the liquid bath from above and are disposed over an entire width of the liquid bath transversely to a flow direction of the liquid, and wherein the front deflecting barrier is disposed just behind the raw material inlet in the flow direction and the rear deflecting barrier is arranged at an approximate center between the first liquid inlet and the first liquid outlet so as to divide a layer of the float product.

2. The separating apparatus as recited in claim 1, wherein the raw material includes coal and wherein the liquid includes a dense medium.

3. The separating apparatus as recited in claim 1, wherein the second inlet and the second outlet are disposed just above a height of a lowermost set of the plurality of sink-product pockets.

4. The separating apparatus as recited in claim 1, wherein the raw material inlet delivers the raw material into the liquid bath in a trajectory parabola and wherein the front barrier is disposed downstream of the trajectory parabola.

5. The separating apparatus as recited in claim 4, wherein the front barrier includes a plate angled transversely to the flow direction and a bottom leg directed obliquely downward in the flow direction, a bottom edge of the bottom leg being arranged parallel to and just below the top level of the liquid bath.

6. The separating apparatus as recited in claim 1, wherein the rear barrier includes a corrugated plate having a leading edge, a trailing edge, and corrugations disposed parallel to one another in the flow direction, the corrugated plate being arranged obliquely such that the leading edge lies approximately parallel to and at a height of the top level of the liquid bath and the trailing edge lies below the leading edge.

7. The separating apparatus as recited in claim 6, wherein the corrugations have a rounded profile.

8. The separating apparatus as recited in claim 6, wherein the corrugations have a V-shaped profile.

9. The separating apparatus as recited in claim 1, wherein the first liquid inlet extends over an entire width of the liquid bath.

10. The separating apparatus as recited in claim 9, wherein the first liquid inlet permits a controlled flow profile over an entire width of the first liquid inlet.

11. The separating apparatus as recited in claim 10, wherein the first liquid inlet includes a vessel extending over the width of the liquid bath, the vessel having at least one inlet opening and a multiplicity of equally spaced outlet openings to the drum, the outlet openings each having a reducible cross-section.

12. The separating apparatus as recited in claim 1, wherein the raw material inlet includes a delivery chute disposed at an incline toward the drum, a base of the chute including a longitudinally corrugated profile, a distance between an end of the base and the top level of the liquid being adjustable.

13. The separating apparatus as recited in claim 12, further comprising a spraying device disposed above the delivery chute for spraying the raw material with water in the direction of the drum.

14. The separating apparatus as recited in claim 1, wherein the plurality of sink-product pockets includes a multitude of sink-product pockets distributed uniformly over the circumference.

15. The separating apparatus as recited in claim 4, wherein the walls of the sink-product pockets are permeable to the liquid.

16. A method for the sink-and-float separation according to density of a mineral raw material using a liquid, the method comprising:

feeding a first portion of the liquid through a first liquid inlet into a rotatable drum of a separating vessel and discharging the liquid through a first liquid outlet disposed directly opposite of the first liquid inlet so as to form a first horizontal flow in a liquid bath in the drum, the first liquid inlet and the first liquid outlet being disposed at and just below the top level of the liquid bath, the drum having a plurality of sink-product pockets distributed over an inner circumference of the drum;

feeding a second portion of the liquid through a second liquid inlet into the rotatable drum and discharging the liquid through a second liquid outlet disposed directly opposite the second liquid inlet so as to form a second horizontal flow in the liquid bath, the second liquid inlet and the second liquid outlet being disposed at a height just above a lowermost set of the plurality of sink-product pockets, the first and second horizontal flows being uniform, essentially laminar, and parallel to an axis of rotation of the drum;

delivering the raw material in a direction substantially parallel to the liquid so that the raw material is plunged into the liquid bath at an inlet side of the drum;

separating a float product of the raw material on a side of the drum opposite the inlet side using an overflow, a sink product of the raw material sinking through the liquid bath; and deflecting a first horizontal flow using a front barrier and a rear barrier, each disposed transversely to a direction of liquid flow, the front and rear barriers projecting into the liquid bath from above, the front barrier being disposed directly downstream of the first inlet and the rear barrier being disposed approximately centrally between the first inlet and the first outlet.

17. The method as recited in claim 16, further comprising uniformly regulating the first horizontal flow over a width of the bath.

18. The method as recited in claim 16, wherein the delivering is performed at high speed.

19. The method as recited in claim 16, wherein the second horizontal flow moves the sink product relative to the liquid and releases float-product fractions adhering to the sink product, so that the float-product fractions can rise into a region of the first horizontal flow.

20. The method as recited in claim 16, further comprising dividing a float-product layer using the rear barrier and reducing a thickness of the float-product layer.

21. The method as recited in claim 16, wherein the deflecting is performed so as to catch a predeterminable fraction of the raw material floating on a surface of the bath and forcing the predeterminable fraction into the liquid.

22. The method as recited in claim 16, further comprising at least one of spraying and water jetting the raw material.

* * * * *